US006019364A

United States Patent [19]

Svyatsky et al.

[11] Patent Number: 6,019,364

[45] Date of Patent: Feb. 1, 2000

[54] MAIL FACING TRANSPORT SYSTEM

[75] Inventors: Eduard Svyatsky, Libertyville; Walter Conard, Lake Villa; John M. Buday, Des Plaines; James Carl McClain, Chicago, all of Ill.

[73] Assignee: Bell & Howell Postal Systems Inc., Lincolnwood, Ill.

[21] Appl. No.: 08/970,797

[22] Filed: Nov. 14, 1997

[51] Int. Cl.[7] ..... B65H 29/00

[52] U.S. Cl. ..... 271/186; 271/291; 271/258.02

[58] Field of Search ..... 271/186, 184, 271/185, 291, 258.01, 258.02, 280, 65, 176; 198/399, 398, 395

[56] References Cited

U.S. PATENT DOCUMENTS

| | | | |
|---|---|---|---|
| 4,119,194 | 10/1978 | Freeman et al. . | |
| 4,693,464 | 9/1987 | Honma | 271/186 |
| 4,993,700 | 2/1991 | Winkler | 271/186 |
| 5,048,814 | 9/1991 | Svyatsky . | |
| 5,449,166 | 9/1995 | Lohmann et al. | 271/185 |

FOREIGN PATENT DOCUMENTS

| | | | |
|---|---|---|---|
| 0067453 | 4/1982 | Japan | 271/186 |

*Primary Examiner*—Christopher P. Ellis
*Assistant Examiner*—Khoi H. Tran
*Attorney, Agent, or Firm*—Sonnenschein Nath & Rosenthal

[57] ABSTRACT

A document transporting system for conveying documents along a transport path in a first direction from a document infeed station to a document processing station, certain of such documents being advanced along the transport path from the infeed station with an improper facing orientation. A plurality of document re-orienting devices are disposed adjacent the transport path between the infeed station and the document processing station. Each of the document re-orienting devices are adapted to receive an improperly oriented document, to reverse the orientation of the previously improperly oriented document, and to transport the correctly oriented document back onto the document transport path. Control elements operatively associated with each of the plurality of document re-orienting devices deliver improperly oriented documents into a pre-selected empty re-orienting device. Correctly oriented documents are conveyed onto the transport path when a gap is present between documents being transported along the document transport path.

15 Claims, 13 Drawing Sheets

MAIL FACING TRANSPORT SYSTEM

The present invention relates to document and mail handling systems, and more particularly, to document and mail transport systems for re-orienting the direction certain documents are facing as the documents are being continually and rapidly fed into a document sorting apparatus.

BACKGROUND OF THE INVENTION

In postal and credit operations, as well as other mass document handling devices, certain documents and envelopes are coded using a bar code and/or optical character keying and printing module, and thereafter the documents are sorted by using a bar code or optical character reader and a sorter. Certain sorting systems in current use also employ image lift address verification units, which electronically recreate the address information normally found on one side of a document, piece of mail, or package. Since typical bar code readers, optical character readers and image lift cameras can economically read only one face of a document at a time, it is important that the documents being transported by the system all face in a uniform direction as they pass in front of the bar code or optical character reader, or an image lift camera.

One prior system for achieving document separation when the documents are not uniformly oriented is disclosed in Freeman et al. U.S. Pat. No. 4,119,194. This patent discloses a single station system for sorting postage bearing mail based upon the location of the postage indicia, utilizing a chute-like receptacle which then ejects and directs pieces to separate right and left conveyors, depending upon whether postage indicia is present adjacent to the right or left edge of an envelope. The conveyors circle and form a closed loop connected to a document transport apparatus. This patent, however, does not disclose a document transport apparatus or system for rapidly transporting a high volume of documents such as mail into a sorting apparatus, while at the same time re-orienting the facing of certain documents and advancing such re-oriented documents back into the moving document transport system.

Another device for re-orienting documents is shown in Svyatsky U.S. Pat. No. 5,048,814, which is commonly owned by the parent entity of the assignee of the present invention. This patent discloses a single document orientation mechanism for reversing the facing of individual documents delivered from a stack of multiple documents while maintaining a predetermined directional document stream. An embodiment of the present invention utilizes and coordinates a plurality of the document orientation mechanisms shown in this patent in seriatim to re-orient and maintain the continual flow of documents along a document transport system.

Mail and document handling systems today must be capable of transporting and sorting documents such as catalogs, packages and other materials of varying thickness. Therefore, devices and mechanisms utilized in mail transport systems must be capable of reviewing and advancing such documents without unduly bending the document during transport. Also, consideration must be given that certain thicker documents resist bending as the documents are advanced through a document transport systems. Therefore, mail handling systems must employ document handling devices or elements which are adapted to handle thicker documents which should not be subject to bending stresses, and documents which inherently resist bending as they are advanced through the mail transport system.

Certain elements of mail and document transport systems are required to pivot or otherwise move rapidly during the operation of the system to handle large volumes of mail in a short time period. This movement is resisted by the inherent inertia of the element or elements to be pivoted or moved, and the inertia is directly proportional to the size of the moving element. It has been discovered that the productivity and efficiency of document handling systems can be increased by incorporating movable elements of reduced size such that minimal inertia is encountered upon operation of the pivotal or moveable element.

In present document conveying and handling systems, errors in document orientation occur at the introduction of the individual document into the processing system. It is important that devices for correcting such errors, such as a document re-orienting apparatus, be property placed along the document path to correct the error prior to additional processing steps and interaction of each document with additional downstream equipment or detectors. It is also important that error sensing devices be disposed sufficiently ahead of the re-orienting device to allow proper control of document infeed and of correction of such error while maintaining maximum productivity of the system.

SUMMARY OF THE INVENTION

An object of the present invention is to provide an apparatus, and system of operation for such apparatus, which efficiently and rapidly re-orients documents being conveyed along a transport path which have indicia on the face of the documents, which document faces in an improper direction whereby the indicia cannot initially be detected by bar code or optical character readers, or image lift cameras disposed adjacent the document transport path.

A further object of the present invention is to employ a plurality of document re-orientation devices in series to allow the rapid re-orientation and continued transport of previously improperly oriented documents being conveyed along a document conveying path.

Another object of the present invention is to provide a plurality of document re-orientation devices in series in a document conveying system, and a controller for controlling the sequence in which each orientation device is utilized, and subsequently emptied, to re-orient and maintain maximum productivity along the document conveying path.

A further object of an embodiment of the present invention is to provide a device for re-orienting the direction a document faces when the document is conveyed along a transport system, which device is adaptable to accommodate documents of varying thickness without unduly bending the document as the document enters and leaves the re-orienting device.

Yet another object of an embodiment of the present invention is to provide a device for re-orienting the direction a document faces when the document is conveyed along a transport system, which device pivots upon entry and egress of the documents into and out of the system, such that the pivoting allows documents to be re-oriented without unduly bending the documents.

An additional object of an embodiment of the present invention is to provide a document re-orienting device which pivots under the influence of a moving document to accommodate the entry and egress of documents into and out of the device, wherein the inertia of the moving parts of the re-orienting device is reduced to a minimum for rapid pivotal movement of the re-orienting device, and the angle of pivotal rotation is determined by the rigidity of the document.

A further object of the present invention is to provide a document handling and conveying system which includes a device along a document transport path for re-orienting improperly facing documents, and an error sensing apparatus juxtaposed adjacent a document infeed station, whereby an erroneously facing document can be detected well in advance of its reaching and being processed by the re-orienting device to maintain continual rapid movement of the documents along the document transport path.

To satisfy these and other objects, the present invention provides a document transporting system, such as a mail processing and conveying system, which transports documents along a transport path in a continual direction from a document infeed station to a document processing station such as a sorter. Certain of such documents will be advanced along the transport path from the infeed station with an improper facing orientation. To properly re-orient these incorrectly facing documents, a plurality of document re-orienting devices are disposed in series adjacent the transport path between the infeed station and the document processing station. Each of the document re-orienting devices are adapted to receive an improperly oriented document, reverse the orientation of the previously improperly oriented document, and to transport the correctly oriented document back onto the document transport path. Control elements are associated with the re-orienting devices and the document transport path for detecting and delivering improperly oriented documents into a preselected empty one of the re-oriented devices, and for subsequently releasing selected correctly oriented documents onto the transport path when a gap is present between documents being transported along the document transport path.

In one embodiment, the re-orienting devices are stationary, and in another embodiment the re-orienting devices are pivotally mounted to permit larger sized and thicker documents to enter and egress the document re-orienting device with no or minimal bending of the document.

In a further embodiment, the overall size of the pivoting re-orienting device is reduced to minimize the effects of inertia upon the pivoting device.

In another embodiment, sensing elements are disposed along the document path and adjacent the document infeed station to permit detection of an improperly facing document sufficiently ahead of the location of the plurality of document re-orienting devices to provide for proper coordination of the operation of the re-orienting devices while maintaining the throughput speed of documents being transported by the system.

In each embodiment, the operation of the plurality of re-orienting devices, the document infeed station and the document transport system is coordinated such that gaps may be created in the stream of properly facing documents on the transport path to permit insertion of re-oriented documents exiting any of the re-orienting devices.

In addition to providing a device for re-orienting an improperly facing document in a stream of documents, the present invention also provides a means for reversing the orientation of documents having images on two sides, where it is desirable to read or obtain an image from both sides of the document during processing.

DETAILED DESCRIPTION OF THE PREFERRED EMBODIMENT

Figure 1:
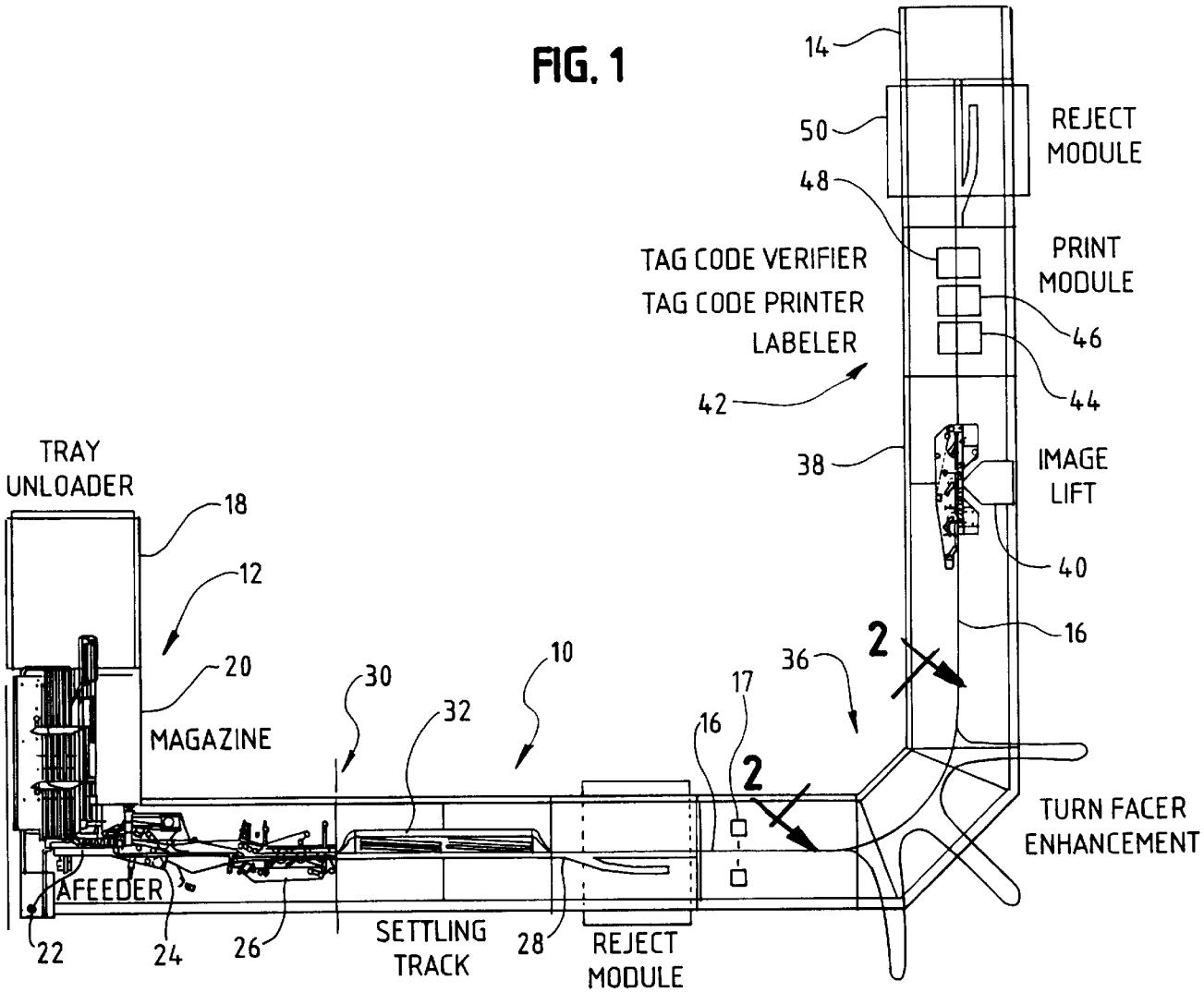
FIG. 1 is a schematic plan view of a document or mail transport and conveying system, including a document infeed station, a document transport path, a document sorter, and several document processing stations disposed adjacent the document transport path, including the document re-orienting devices of the present invention.

FIG. 1 illustrates a document transporting and processing system generally designated by the numeral 10, which includes a document infeed station 12 at one end and a document sorter apparatus 14 at an opposite end. A document transport path, generally indicated by the numeral 16 extends between the document infeed station 12 and the sorter apparatus 14. The document transporting and processing system 10 illustrated in FIG. 1 is typically utilized to process and sort mail pieces in accordance with destination, or ZIP, codes appearing on one face of each mailpiece. However, the system illustrated in FIG. 1 can be used to convey and process documents other than mail, which documents include an identifying symbol or language on at least one surface of each document. The specific system 10 illustrated in FIG. 1 is adapted to transport and process documents of varying size and thickness, including single or folded page documents, standard mail envelopes, and thicker, larger mail pieces such as books, catalogs, packages, magazines, directories and the like.

The document infeed station 12 of FIG. 1 includes an automatic tray unloader 18, a document advancing magazine 20, a shingled document transport system 22 and two document separators 24, 26 to ensure that documents enter transport path 16 one at a time in a linear array, with each document in a vertical position held between a belt system 28 which forms part of transport path 16. The infeed station ends at the vertical plane designated 30 in FIG. 1.

The transport path 16 in the system 10 of the illustrated embodiment includes a settling track 32 for obtaining a preferred registration of the documents as the documents are advanced from the infeed station 12. The illustrated embodiment of system 10 also optionally includes several functional modules, such as a weighing module 34.

The illustrated document processing system 10 includes a ninety degree turn, designated 36, wherein document transport path 16 continues to advance documents to an image lift station 38. The document re-orienting apparatus of the present invention extends along the right angle turn 36, as will subsequently be explained. At image lift station 38, an electronic image of the address side of the mail document is recorded, preferably by CCM camera 40. The image produced in the CCM camera is utilized to further identify, tag, and overlabel documents to cure destination code irregularities and to control and track subsequent sorting of the documents.

In the illustrated embodiment, an optional print module 42, comprising a labeler 44, tag code printer 46 and tag code verifier 48, may be located downstream of image lift station 38. A reject module 50 may be disposed along document transport path 16 to divert any document which cannot be processed by the sorting system 14 disposed adjacent the reject module 50. Sorting system 14 comprises numerous pockets or receptacles (not shown) which receive and stack mail documents having a common destination, or ZIP, code. The stacked and sorted documents are periodically removed from the receptacles in sorting system 14, and transported to their appropriate destination.

Figure 2:
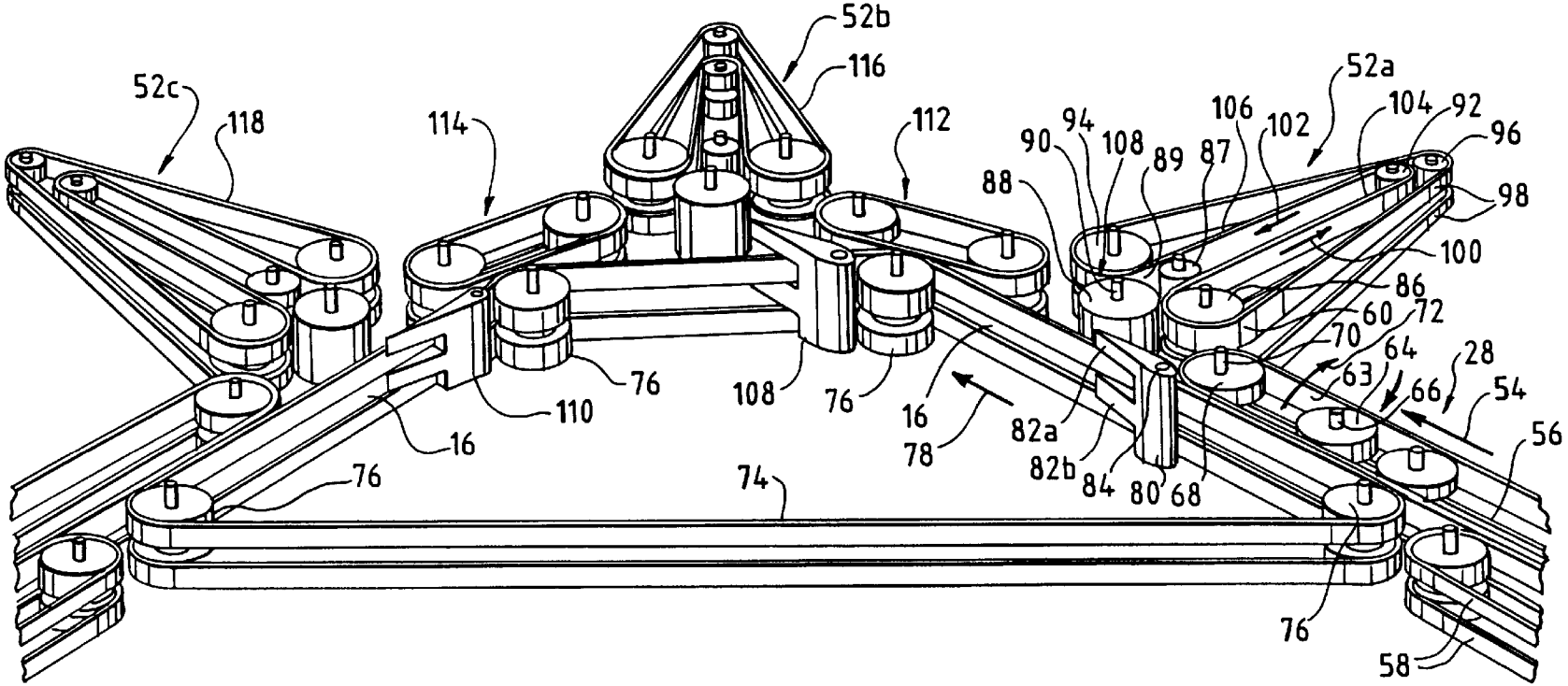
FIG. 2 is a perspective view of the plurality of re-orienting devices of the transport and conveying system of FIG. 1, showing one embodiment of the present invention as viewed along line 2—2 of FIG. 1.

FIG. 2 illustrates the preferred arrangement of a plurality of re-orienting devices 52A, 52B, and 52C disposed at the ninety degree turn segment 36 of the document transporting and processing system 10 (FIG. 1). Each of the re-orienting devices 52A, B and C are substantially as disclosed and described in U.S. Pat. No. 5,048,814, the disclosure and description of which is incorporated herein by reference. However the re-orienting devices 52A, B and C of the present invention are configured for selective stopping and starting the movement of the belts forming part of the selective stopping and starting the movement of the belts forming part of the re-orienting devices, to hold a document in the device for a necessary period of time, to be described below.

The re-orienting devices 52A, B, C are located in a perpendicular plane adjacent the document transport path which is generally designated by the arrow 54 in FIG. 2. Arrow 54 also designates the direction documents are moving in the transport path 16 (FIG. 1) as they are conveyed by document transport and processing system 10 (FIG. 1). The document path 16 approaching re-orienting device 52A comprises a pair of belts 56, and a pair of opposed belts 58, all mounted upon and suitably driven by roller systems as is known in the art. Belts 56 and 58 are disposed closely adjacent one another, and travel at the same speed such that the facing belt portions are driven in the same direction, and are adapted to grip mail pieces or documents between the belt portions to propel the documents in the direction shown by arrow 54.

Just ahead of the entrance 60 to re-orienting device 52A is a double belt and roller assembly 62, wherein the belts 63 are driven in a clockwise direction as viewed in FIG. 2. The belts 63 of assembly 62 extend around a roller 64, which roller rotates about a stationery shaft 66, and the belts 63 also extend around a corresponding roller 68 which is mounted on a shaft 70 which is capable of arcuate movement about shaft 66 as shown by arrow 72. This construction allows belt and roller assembly 62 to pivot towards the entrance 60 when a document is diverted into re-orienting device 52A, as will be explained.

The document path 16 (FIG. 1) also includes a double belt assembly 74 which extends around a roller system defined by rollers 76 and is driven in the direction shown by arrow 78. Belt assembly 74 is disposed closely adjacent belts 63 to engage documents moving along the document path 16 for the purpose of advancing the documents in the general direction of entrance 60 of re-orienting device 52A.

A diverter mechanism 80 is disposed adjacent the entrance 60 to re-orienting device 52A, and includes a pair of fingers 82A,B which extend into the document path 16 when the diverter 80 is rotated through a short clockwise arc about shaft 84. Diverter mechanism 80 can be rotated by any suitable means, such as a selectively controlled solenoid activator. In the configuration illustrated in FIG. 2, actuation of diverter 80 through a short clockwise arc will divert a document in the document path 16 moving in direction 54 towards and into entrance 60 of re-orienting device 52A. When diverter mechanism 80 remains non-activated, the document will pass in front of entrance 60, will not be diverted into re-orienting device 52A, and will continue to move along document path 16 towards re-orienting device 52B.

Re-orienting devices 52A, B and C are all similarly constructed, and the description of the elements of re-orienting device 52A is equally applicable to re-orienting devices 52B and 52C. The entrance 60 of re-orienting device 52A is defined by rollers 86, 87 and 88, and belt 89 extending around rollers 87 and 88. In the illustrated embodiment, roller set 86 is rotatable about a fixed shaft, and roller 88 is mounted on a fixed shaft 90. Roller 87 moves through a small pivoted arc to vary the space between the belts extending around rollers 86 and 87 to accommodate relatively thicker documents and/or mail pieces which pass between the belts 89 and 98, as will be explained. Roller 87 is biased in the clockwise direction and pivots around shaft 90 towards belt 98.

Re-orienting device 52A further comprises a plurality of roller sets 92, 94, 96, and a double belt 98 extends around roller set 86 and roller sets 92, 94 and 96 as illustrated in FIG. 2. One of the roller sets is connected to a drive motor (not shown), which moves belt 98 in the directions shown by arrows 100, 102. Re-orienting device 52A also includes a laterally moveable deflection guide arm (not shown) which extends between the upper and lower runs of double belt 98 to urge a document located between portions 104 and 106 of belt 98 towards engagement with belt portion 106, as will be explained and as described in U.S. Pat. No. 5,048,814.

A document diverted by mechanism 80 into entrance 60 of re-orienting device 52A will be transported by the movement of portion 104 into the space formed between portions 104 and 106 of belt 98. If the deflector guide arm (not shown) is not activated, the document will remain adjacent belt portion 104 and will remain in the re-orienting device 52A. Also, if the movement of belt 98 is halted after the document reaches its position between belt runs 104 and 106, the document will remain in re-orienting device 52A.

Upon activation of the deflector guide arm (not shown) in a leftward direction as viewed in FIG. 2, with the belt 98 moving in directions 100, 102, the document is urged away from belt portion 104 and into contact with belt portion 106, which drives the document through exit nip 108 formed between the belts extending around roller sets 88 and 94 and back onto document path 16.

However, it is important to note that the document has now effectively been turned 180 degrees, and is facing in the opposite direction relative to when the document entered entrance nip 60. The re-oriented document now has its information panel, such as address data, facing the proper direction for subsequent processing, such as bar code or optical character reading, or image lift processes.

As the document exits re-orienting device 52A, the document is located again on document path 16. Since this document has been correctly oriented, diverter gates 108 and 110 adjacent re-orienting devices 52B and 52C remain unactivated, whereby the document continues along document path 16, past the entrances of re-orienting devices 52B and 52C, and towards the image lift station 38 (FIG. 1).

Located ahead of re-orienting device 52B along document path 16 is a belt and roller assembly 112, which has the same construction and operation features as belt and roller assembly 63 ahead of re-orienting device 52A. A document approaching re-orienting device 52B is engaged by belt and roller assembly 112 and belt 74, and is advanced toward diverter gate 108. If gate 108 is not activated, the document continues along document path 16 until the document is engaged between belt and roller assembly 114 and belt 74. If diverter gate 108 is activated as the document is engaged between belt and roller assembly 112 and belt 74, the document is diverted into re-orienting device 52B, and the process of changing the orientation of the document by re-orienting device 52B is carried out as set forth above in describing the operation of re-orienting device 52A and its associated elements.

Likewise, a document passing belt and roller assembly 114 and heading towards re-orienting device 52C would travel the path dictated by the position of diverter gate 110. If the gate 110 is in a de-activated position, the document will pass by, and not enter, re-orienting device 52C. If the gate 110 is activated, the document will be diverted to re-orienting device 52C and the orientation of the document will change by 180 degrees. Upon exiting re-orienting unit 52C, the properly faced document is transported along path 16 for further processing.

Each of diverter gates 80, 108 and 110, as well as the incremental movement of belts 98, 116, and 118 of re-orientation devices 52A, B and C respectively, are controlled by a master control unit (not shown) which is responsive to signals reflecting the location of documents in the transport path 16, the orientation of such documents, and the presence or absence of gaps between documents being sequentially transported along document path 16. A gap sensor 17 is shown in FIG. 1 ahead of ninety degree turn 36. Another factor in the control of the above-described system is the presence or absence of a document in any one of the re-orienting devices 52A, B, or C.

Figure 3A:
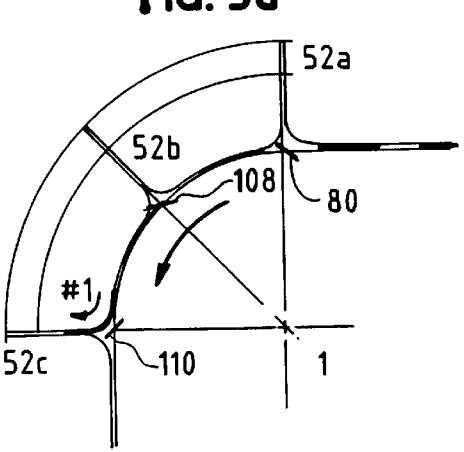
FIGS. 3A–3L are a series of schematic diagrams showing the algorithm for controlling the sequence of operation of the re-orienting devices illustrated in FIG. 2.

The algorithm of operation of the re-orienting apparatus illustrated in FIGS. 1 and 2 is explained with reference to the several diagrams comprising FIGS. 3A through 3L. FIG. 3A illustrates the condition wherein a document has been detected facing the incorrect direction, and the control system activates diverter gate mechanism 110 to divert the first document into re-orienting device 52C, where the document is held. In FIG. 3A, diverter gates 80 and 108 are configured to allow the document 1 to pass to re-orienting device 52C. Document 1 cannot be released from re-orienting device 52C at this juncture of the operation, since there is no gap in the continuing stream of documents moving along path 16 in which document 1 can be deposited. The documents are moving along path 16 at approximately two meters per second, and sometimes faster. In FIG. 3A, as well as in all other FIGS. 3B through 3L, it is assumed that the documents continuing to move on transport path 16 are all correctly faced, except those being diverted as will be explained.

Figure 3B:
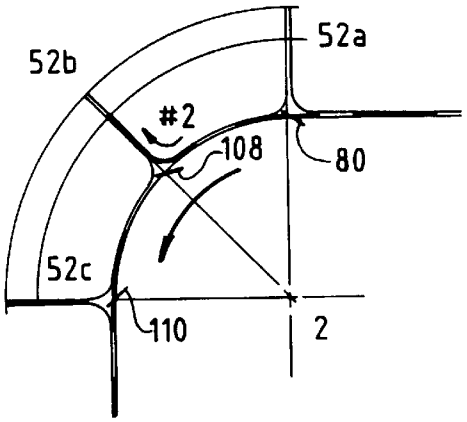
Figure 3C:
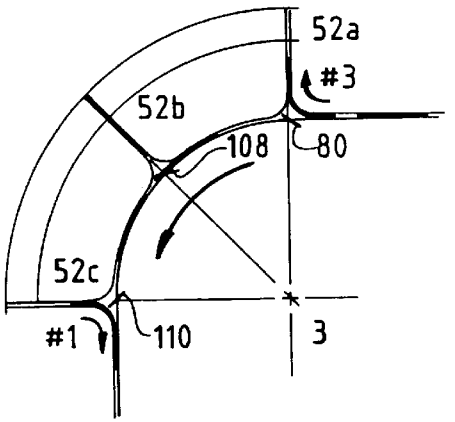

FIG. 3B illustrates the condition whereby a second envelope facing in the wrong direction has been detected, and this envelope is diverted into re-orienting device 52B by actuation of diverter gate 108. By the diversion of document 2 into re-orienting device 52B, a gap has now been created in the stream of documents moving along transport path 16, and as illustrated in FIG. 3C, document 1 is now released from re-orienting device 52C, with its face re-oriented by 180 degrees, into transport path 16 in the gap created by the diversion of document 2 into re-orienting device 52B. Also illustrated in FIG. 3C is the condition whereby a third improperly faced document is detected by the system's sensors and document 3 is diverted by actuation of diverter gate 80 into re-orienting device 52A. As shown in FIG. 3C, re-orienting device 52C is now empty, and document 2 is retained in re-orienting device 52B.

Figure 3D:
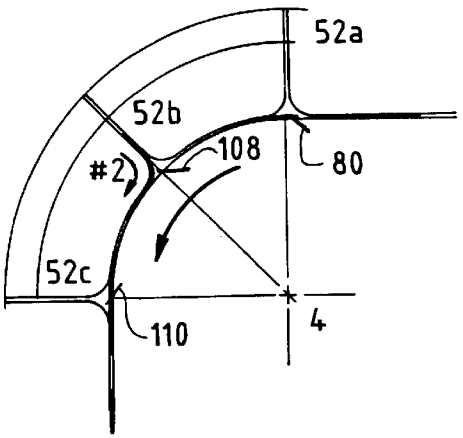

Upon the diversion of document 3 into re-orienting device 52A, a gap in the document stream is formed, and document 2 in re-orienting device 52B is released into the stream of documents in path 16. The orientation of document 2 has been changed as previously described by 180 degrees. Therefore, as also illustrated in FIG. 3D, at this juncture of operation, a document is located in re-orienting device 52A, and re-orienting devices 52B and 52C are empty.

Figure 3E:
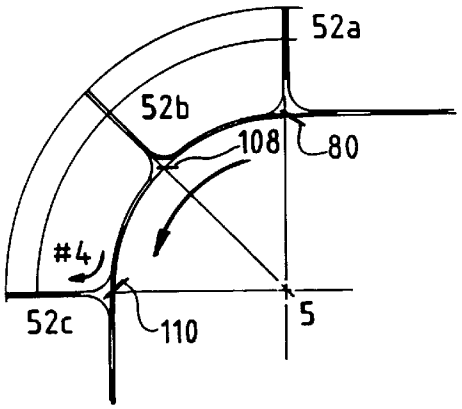

FIG. 3E illustrates the condition where a fourth improperly faced document is detected, and this document is delivered to re-orienting device 52C by actuation of diverter mechanism 110. Document 3 remains in re-orienting device 52A since the gap formed in the stream of documents by the diversion of document 4 is beyond the position of re-orienting device 52A. Therefore, there is no gap in the stream for document 3 to enter.

Figure 3F:
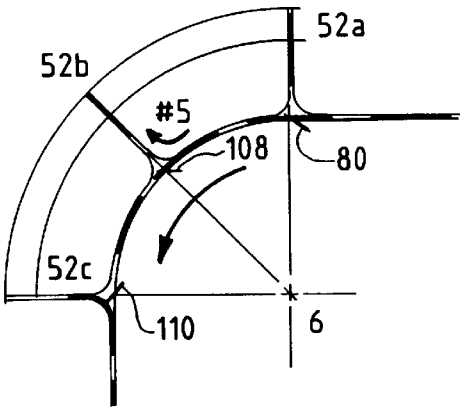
Figure 3I:
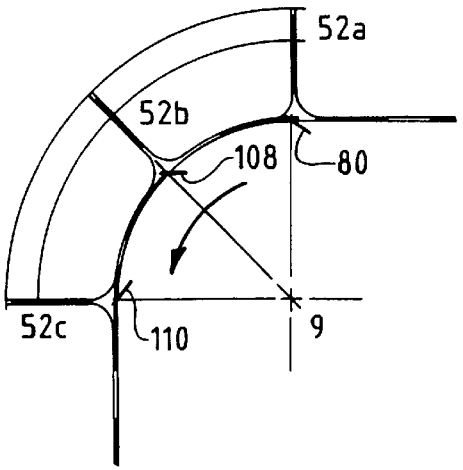

FIG. 3F illustrates the condition where a fifth improperly oriented document is detected, and this document is advanced to re-orienting device 52B by actuation of diverter gate 108. The diversion of document 5 into re-orienting device 52B creates a gap in the stream of documents, which gap passes adjacent re-orienting device 52C. As shown in FIG. 3G, document 4, which has previously been held in re-orienting device 52C, is now released into the gap formed by the diversion of document 5 into re-orienting device 52B. At the juncture of operation shown in FIG. 3G, document 3 remains in re-orienting device 52A and document 5 remains in re-orienting device 52B, while re-orienting device 52C is empty.

Figure 3H:
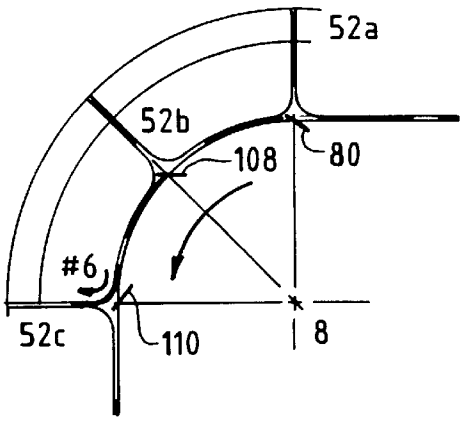
Figure 3G:
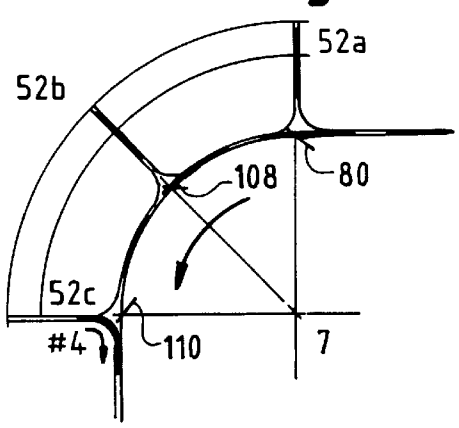

FIG. 3H illustrates the condition whereby a sixth improperly faced document is detected, and this document is advanced into re-orienting device 52C by the actuation of diverter mechanism 110. Since the gap formed by the diversion of document 6 is downstream of re-orienting devices 52A and 52B, documents 3 and 5 in each of these re-orienting devices respectively, cannot be introduced back into the document stream since there is no gap present.

Figure 3L:
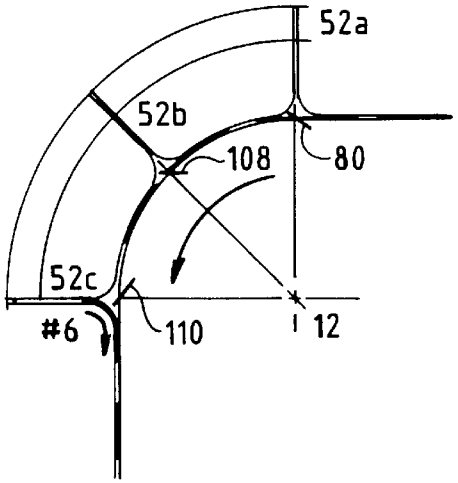
Figure 3K:
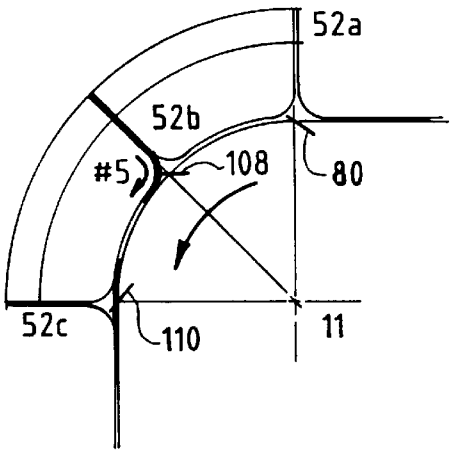
Figure 3J:
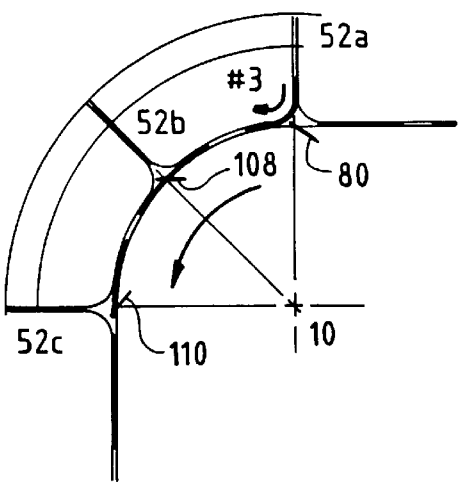

FIG. 3I represents the condition whereby all three re-orienting mechanisms, 52A, 52B and 52C are occupied with documents to be re-oriented. At this point in the operation, a signal is sent to the control mechanism operating document infeed station 12, which functions to create three gaps in the document stream heading towards the re-orienting mechanisms at the turn 36 of the system. As shown in FIG. 3J, document 3 in re-orienting device 52A is released into the first gap formed by the infeed station 12. Likewise, document 5 is released into the second gap formed by the document infeed station 12, as shown in FIG. 3K, and FIG. 3L illustrates document 6 being released into the third gap in the document stream. At the end of the operation illustrated in FIG. 3L, each of the re-orienting devices 52A, 52B and 52C are empty, and the cycle as described beginning with FIG. 3A can be repeated.

In another embodiment of an operative sequence for controlling the transport of documents in document transporting and processing system 10 (FIG. 1), and to avoid the loss of productivity using the system 10, a facer sensor is located at plane 30 at the end of infeed station 12. This sensor can also be located at the beginning of settling track 32. The sensor is connected to an operating system that can stop advancement of the document infeed station 12 and prevent the supply of additional documents, but cannot stop documents already on the settling track and beyond in the document transport path 16. When the sensor located at plane 30 detects an improperly faced document, a signal is created and sent to a microprocessor (not shown) which controls the operation of the infeed station 12 and the re-orientation devices. The intelligence of the microprocessor dictates that six envelopes or documents improperly faced can be advanced into the re-orienting devices 52A, B and C, and these documents will have their orientation reversed. The microprocessor also knows that additional documents cannot be sent into the system. Therefore, the microprocessor controls the infeed station 12 whereby a gap for three envelopes is automatically introduced into the transport path 16 after the sensor senses that six improperly faced documents have been advanced towards the re-orienting devices 52A, B and C. Following the creation of this three envelope gap, then six more improperly faced documents can be detected and then the microprocessor again creates a gap for three envelopes and the cycle repeats. In other words, the microprocessor is programmed to count the number of improperly faced documents received from the facer sensor located at plane 30. After the sixth envelope has been detected, the feeder operation in interrupted, a three envelope gap is introduced into the transport path, and the sequence of operation continues to run until six more improperly faced documents are detected.

Figure 4:
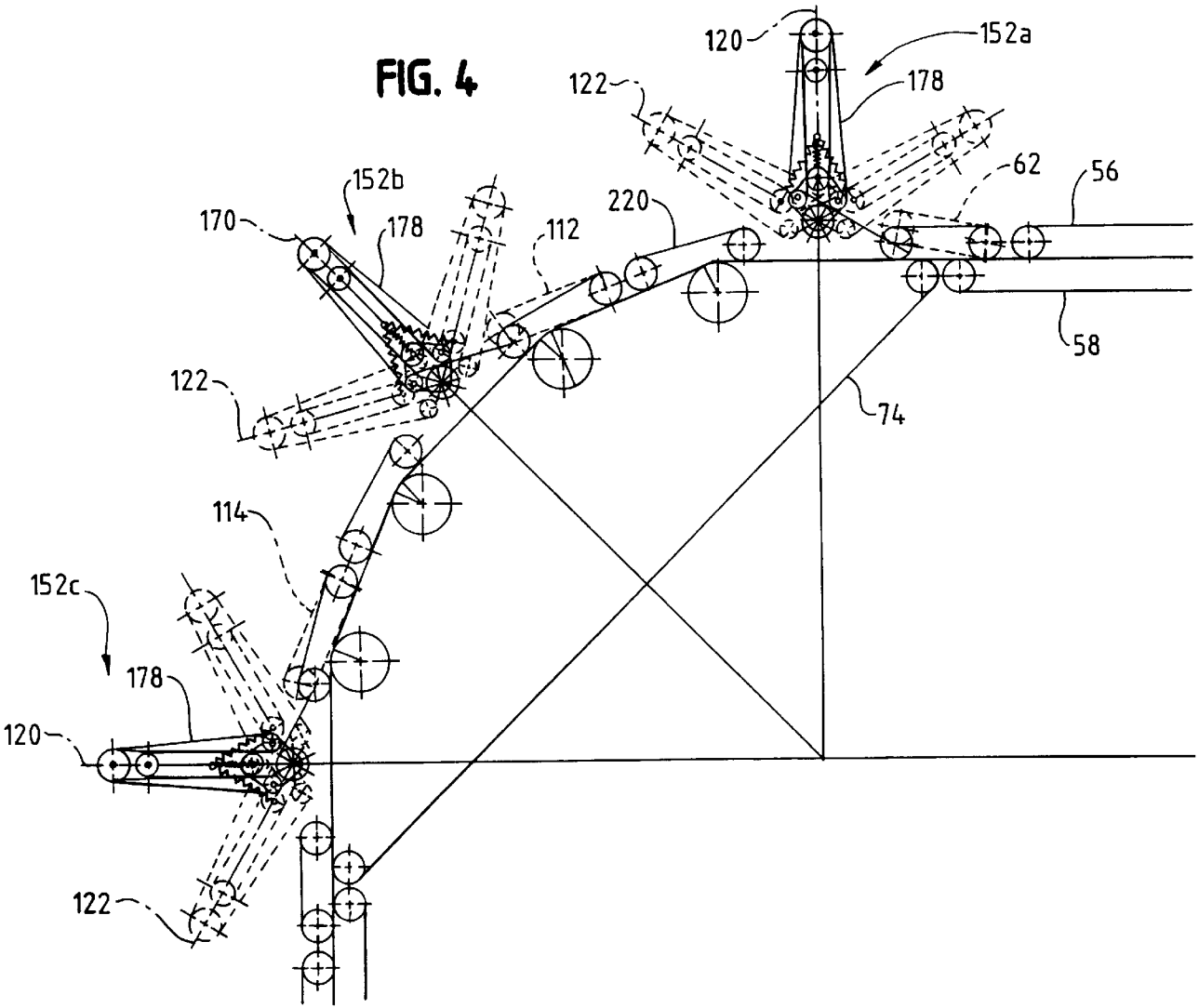
FIG. 4 is a schematic plan view of a further embodiment of the re-orienting devices and document transport system of the present invention, wherein each of the re-orienting devices is capable of rotating upon the entry and egress of a relatively thick document.
Figure 5:
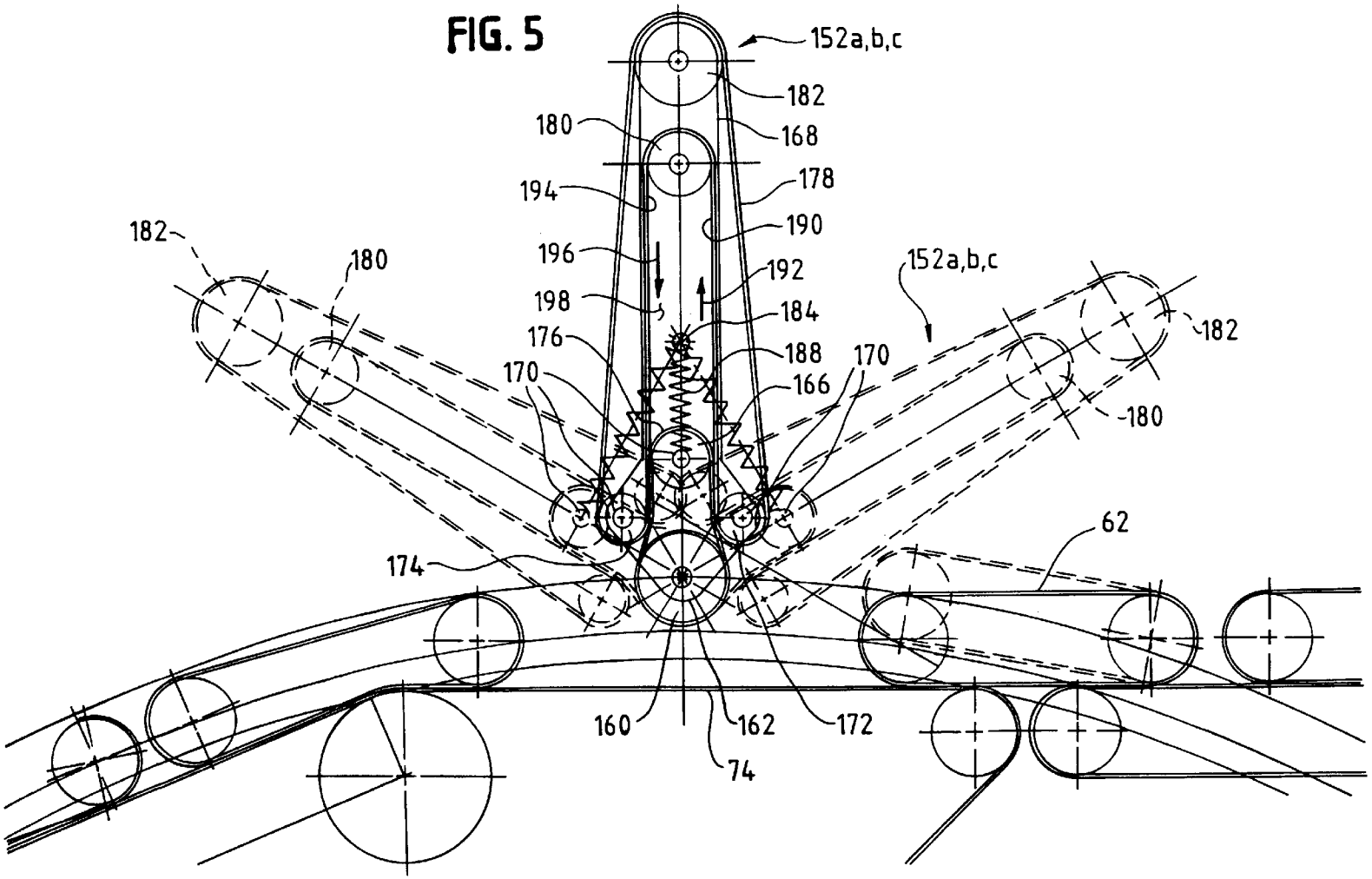
FIG. 5 is a diagrammatic plan view of one of the re-orienting devices of FIG. 4, illustrating the positions to either side of center that the re-orienting device can rotate upon entry or egress of a relatively thick document.
Figure 6:
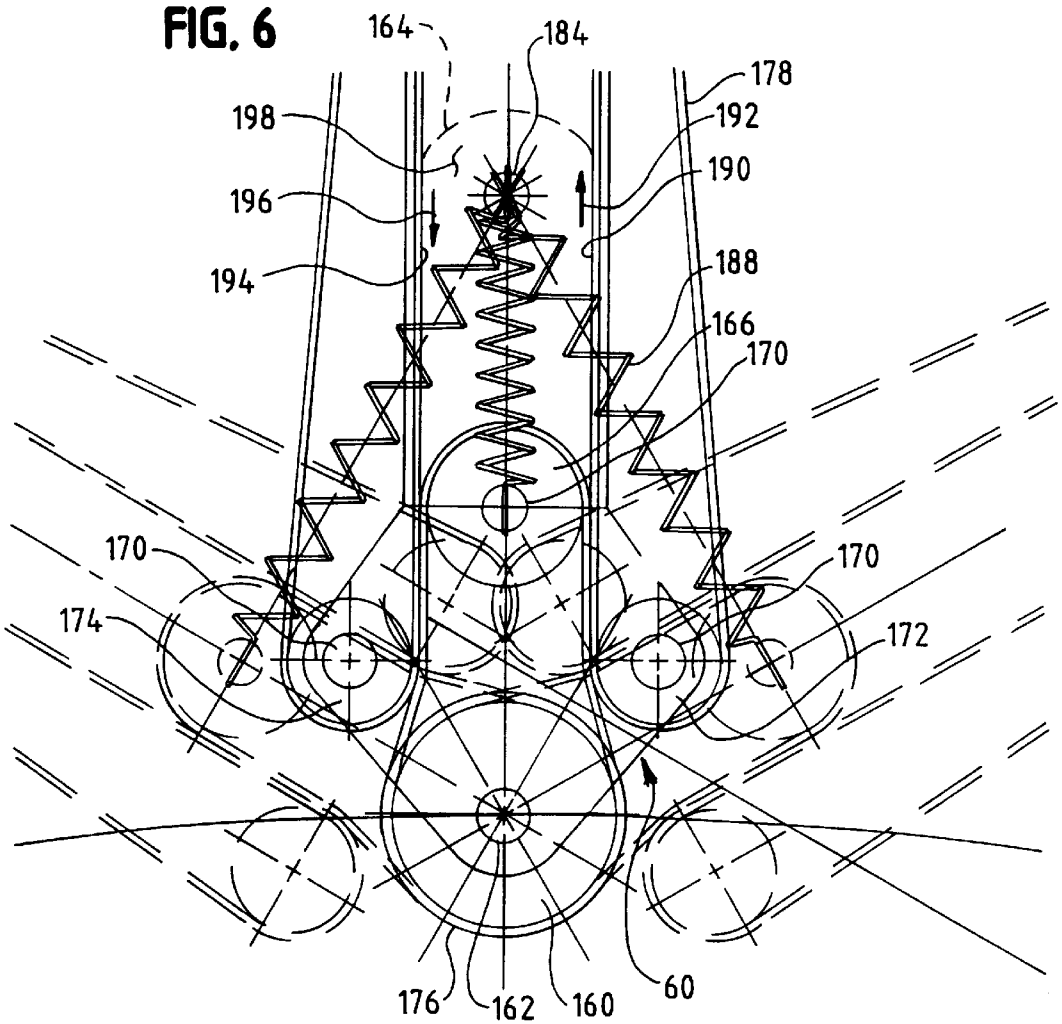
FIG. 6 is a diagrammatic plan view of a section of the re-orienting device of FIG. 4, illustrating the resilient bias mechanism directing the pivoting re-orienting device to its two extremes and to a central position.

FIGS. 4 through 6, inclusive, illustrate a further embodiment of the present invention which is constructed to allow pivotal movement of the re-orienting devices and prevent undue bending of thicker mail pieces and documents upon entrance into and egress out of the respective re-orienting devices. In the embodiment of the invention illustrated in FIGS. 4 through 6, like parts bear the same numeral as in FIGS. 1–3.

FIG. 4 diagrammatically illustrates the relative position of pivotal re-orienting devices 152A, 152B and 152C. Each of the re-orienting devices is constructed, as will be explained, to pivot from a central position 120 to a counterclockwise position 122 upon the entrance of a relatively thick document. Each of the re-orienting devices 152A, B and C are positioned relative to each other in the same manner as in the embodiment illustrated in FIG. 2.

FIG. 5 is a detail view of one of the pivotal re-orienting devices 152A, B and C of FIG. 4, and its associated elements. In this embodiment, an entrance roller 160 is rotatably mounted on a fixed shaft 162, and the shaft 162 is mounted on a stationery plate 164 (FIG. 5C). A second roller 166 is rotatably mounted on a pivotal plate 168. A pair of guide rollers 172, 174 are also rotatably mounted on pivotal plate 168 on shafts 170 fixed to the pivotal plate. A first belt 176 extends around rollers 160 and 166. A second belt 178 extends around roller 172, then around roller 180, back around roller 174, over roller 182 and back to roller 172, in the same manner that belt 98 extends around rollers 86, 92, 94 and 96 in the embodiment of FIG. 2. The shafts about which rollers 180 and 182 rotate are also mounted on pivotal plate 168. Thus, the entire assembly of each re-orienting device 152A, B, C is rotatable about shaft 162 and roller 160.

Each reorienting device 152A, B, C is biased to return to a central position, shown in solid lines in FIG. 5. Referring to FIGS. 5 and 5C, a pin 184 extends a short distance upward from stationery plate 164 such that pin 184 does not interfere with the movement of rotating plate 168. A second pin 186 extends downward from rotatable plate 168, and a tension spring 188 extends between the two pins 184 and 186. In the embodiment of FIG. 5, pin 186 is coaxial with shaft 170 about which roller 166 rotates. If preferred, shaft 170 and pin 186 could be combined into a unitary structure. As plate 168 rotates in either direction from its central disposition, as illustrated in phantom in FIG. 5, spring 188 urges rotating plate 168 back towards the central position. Rollers 166, 172, 174, 180 and 182 are all mounted on rotating plate 168, as well as belt 178 which extends between these rollers. One of rollers 172, 174, 180 or 182 is a drive roller, suitably connected to a power source (not shown) to selectively drive the belt 178 around the respective rollers. When driven, a portion 190 of belt 178 advances in the direction shown by arrow 192, and a second portion 194 of belt 178 moves in the opposite direction, as illustrated by arrow 196. The space 198 defined by belt portions 190 and 194, and by rollers 166 and 180 is maintained as re-orienting device 152A, B, C rotates in either direction as illustrated in FIG. 5.

Figure 5B:
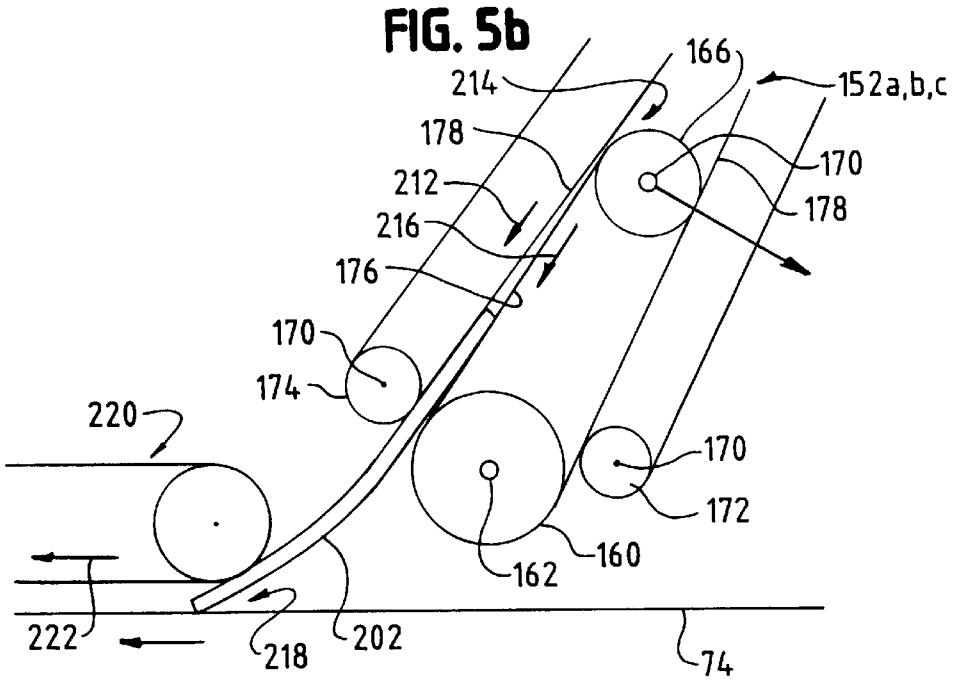
FIG. 5B is a detail schematic plan drawing of the egress portion of one of the re-orienting devices of FIG. 4, illustrating how the released document causes the re-orienting device to rotate.
Figure 5A:
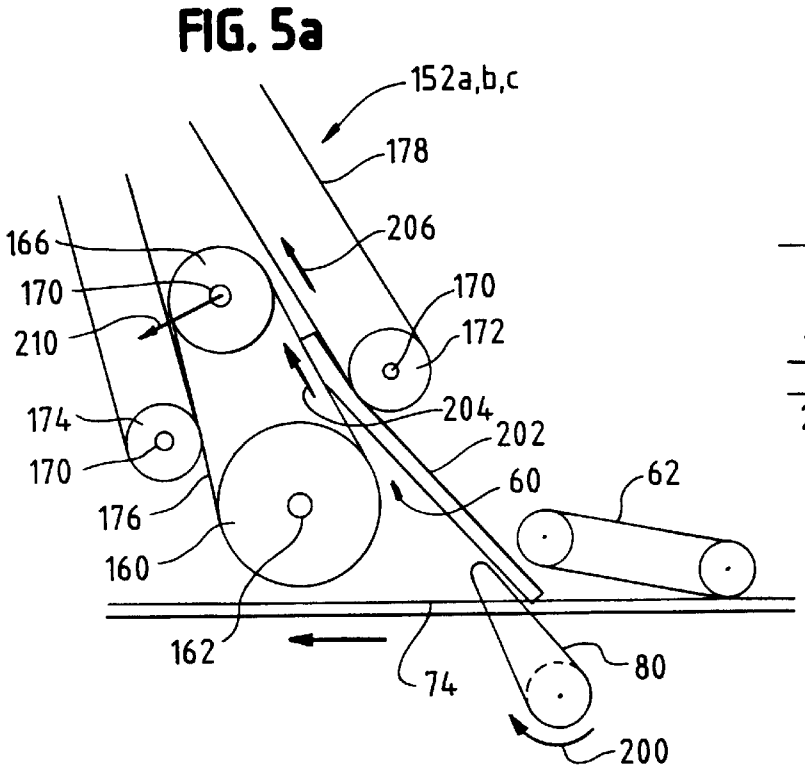
FIG. 5A is detail schematic drawing of the entrance portion of one of the re-orienting devices of FIG. 4, illustrating how the entering document causes the re-orienting device to rotate.
Figure 5C:
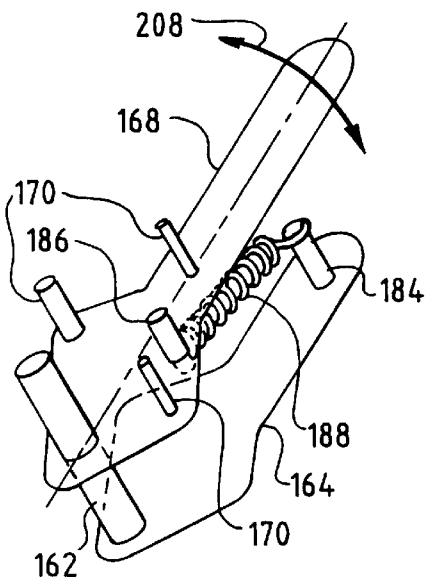
FIG. 5C is a perspective exploded schematic view of the stationary and rotating plates forming the re-orienting devices of FIG. 4, illustrating the resilient connection between the two plates which biases the rotating plate to a central or neutral position.

FIGS. 5A and 5B schematically illustrate how a document acts upon each re-orienting device 152A, B, C when the document enters (FIG. 5A) or is released from (FIG. 5B) a re-orienting device. Referring first to FIG. 5A, diverter mechanism 80 has been activated upon a signal from the control microprocessor (not shown) to rotate in the direction shown by arrow 200 and divert document 202 into the entrance nip 60 formed between rollers 160 and 172. Document 202 is gripped between belts 176 and 178, which are moving in the direction shown by arrows 204 and 206, respectively, around their respective roller assemblies, as illustrated in FIG. 5.

Roller 160 is rotatably mounted on shaft 162, and rollers 166, 172 and 174 are each rotatably mounted on a shaft 170. Each shaft is fixed to plate 168 (FIG. 5C) which plate is mounted for limited rotation about shaft 162, as illustrated by arrow 208 in FIG. 5C. Thus, rollers 166, 172 and 174 are capable of revolving in an arc about pin 162.

As document 202 is advanced between moving belts 176 and 178, and is under the influence of forces applied by leftward moving belt 74 and belt and roller assembly 62 on the trailing faces of document 202, lateral forces will be applied to the leading portion of the document, tending to bend the document. Thicker documents 202 will tend to resist these bending forces, and the document will apply a reaction force to the portion of belt 176 which the document 202 is contacting. This reaction force on belt 176 will compel plate 168 (FIG. 5C) to rotate counterclockwise, as viewed in FIG. 5C, and rollers 166, 172 and 174, and their associated belts 176 and 178 all move in a short arc in the direction shown by arrow 210 in FIG. 5A. This movement brings the gap which grips the document between belts 176 and 178 into substantial alignment with the longitudinal axis of the document, and the document 202 can be conveyed completely into re-orienting device 152A, B, C whereby the trailing edge of document 202 eventually is disposed beyond the outer circumference of roller 166 and belt 176. Once document 202 is in this position, the re-orienting device rotates about pin 162 back to its central position under the influence of spring 188 (FIG. 5).

FIG. 5B illustrates the condition of the re-orienting device of the present invention upon release of a document from one of the re-orienting devices upon receipt of a release signal from the control microprocessor. As viewed in FIG. 5B, the document 202 has been deflected leftward until one of its faces contacts the left rim of belt 178 which is moving in the direction shown by arrow 212. The document is driven into the nip 214 formed between belt 178 and the leftward rim of belt 176, which is moving in the direction illustrated by arrow 216.

Document 202 advances past rollers 160 and 174 until the document's leading edge contacts moving belt 74, and is driven into the nip 218 formed between double belt assembly 74 and belt and roller assembly 220. The belts of assembly 220 move in the direction shown by arrow 222. As document 202 advances into nip 218, forces are applied tending to bend the document between rollers 160 and 174. Due to the relative thickness of the document, a reaction force resisting the bending is applied to the left rim of belt 176 and roller 160, as viewed in FIG. 5B. This reaction force applied to belt 176 and roller 160 causes plate 168 to rotate clockwise as shown by arrow 208 in FIG. 5C. The space between belts 176 and 178 is which grip the document 202 comes into substantial alignment with the longitudinal faces of document 202, thus removing the bending stresses applied to the document were the re-orienting device not capable of rotation as described. After the trailing edge of document 202 moves beyond rollers 160 and 174, the re-orienting device and plate 168 (FIG. 5C) rotate back to the central position shown in FIG. 5 under the influence of spring 188.

FIG. 5C is a detail illustration showing the relative movement between plate 164, which is fixedly mounted on the support (not shown) for the re-orienting devices 152A, B, C, and plate 168 which rotates relative to fixed plate 164 about pin 162. As described previously in conjunction with FIGS. 5 and 6, roller 160 is rotatably mounted on the upper portion of pin 162, and rollers 166, 172 and 174 are rotatably mounted on pins 170. Plates 164 and 178 are vertically separated by a small distance, and pin 186 extends downward from the underside of plate 168. Pin 184 extends upward a short distance from fixed plate 164, and pin 184 is laterally disposed several inches from pin 186. Spring 188, or any suitable resilient force means, extends between pins 186 and 184. When plate 168 is rotated in either direction as shown by arrow 208 under the influence of a relatively thick document entering or exiting a re-orienting device 152A, B, C, the spring 188 returns plate 168 to its central position shown in FIGS. 5 and 6.

The operation of the embodiment of the invention illustrated in FIGS. 4–6 is the same as described previously in association with FIGS. 3A–3L.

Figure 7:
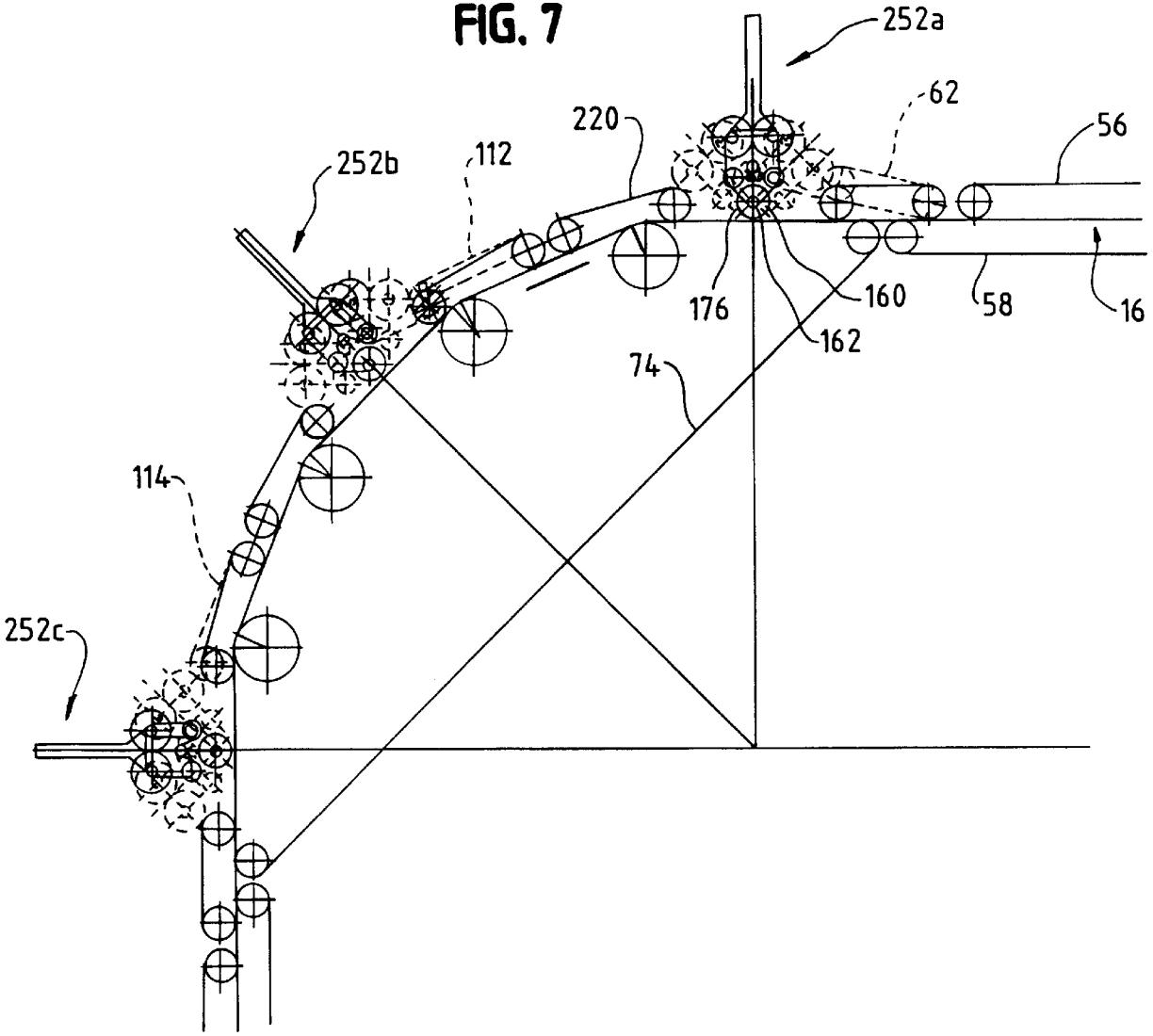
FIG. 7 is a schematic plan view of a further embodiment of the re-orienting devices and document transport system of the present invention, wherein each of the rotating re-orienting devices utilizes a pair of nip rollers to engage and hold a document for re-orientation.
Figure 8:
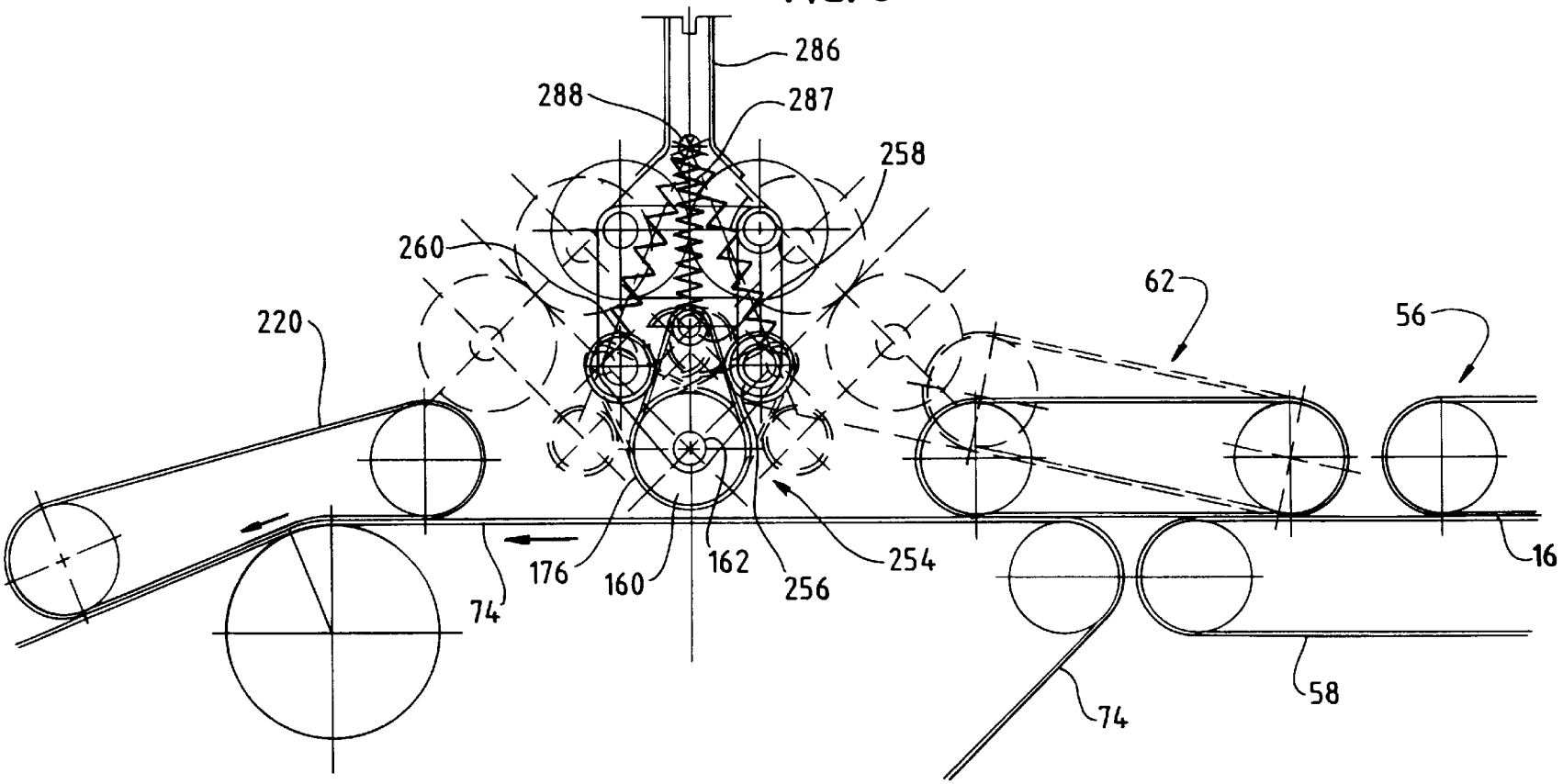
FIG. 8 is a detail schematic view of one of the re-orienting devices of FIG. 7, illustrating the re-orienting device in its central position and in its two positions when rotated upon the entrance and egress, respectively, of a relatively thick document into and out of the re-orienting device.

A further embodiment of the present invention is illustrated in FIGS. 7–10, wherein three document re-orienting devices 252A, B and C are disposed adjacent document transport path 16. This embodiment is designed to reduce the size and weight of the individual document re-orienting devices, and thus reduce the inherent inertia in each device as it rotates when relatively thick documents enter or exit each re-orienting device. Elements of the embodiment of FIGS. 7–10 which are similar to elements in FIGS. 1–6 are like numbered. FIGS. 7 and 8 illustrate the three re-orienting devices 252A, B and C in their central position, and the rotational position of each device is shown in phantom.

Figure 9:
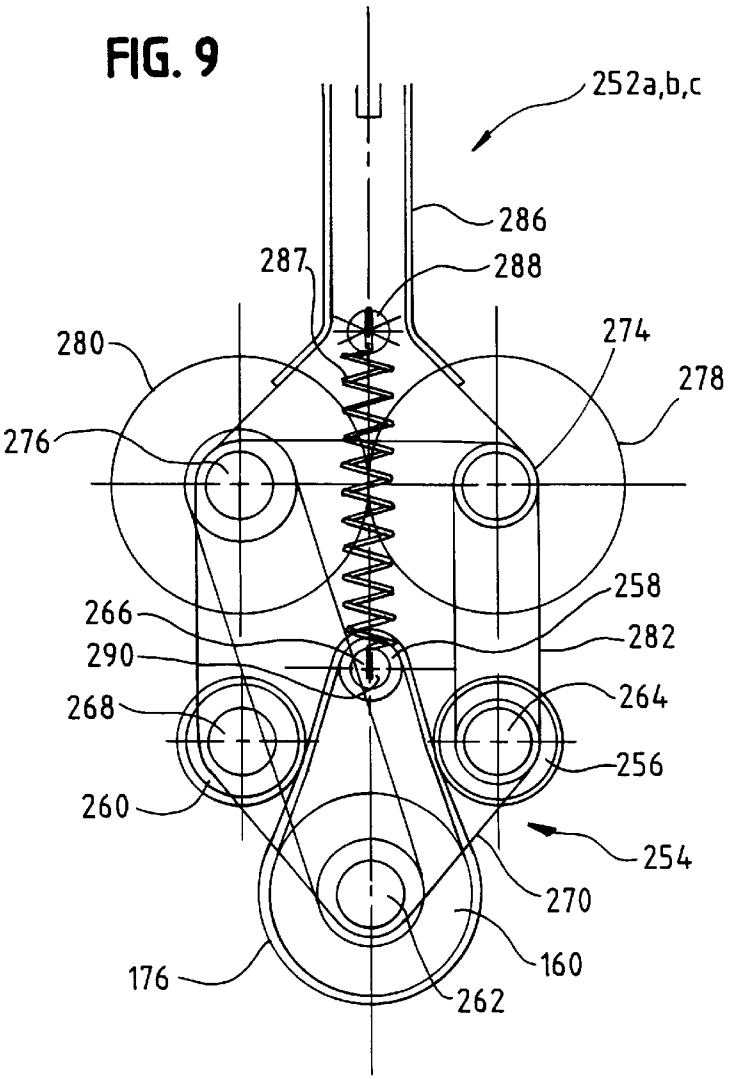
FIG. 9 is a detail plan view of one of the re-orienting devices of FIG. 7, illustrating the resilient connection between the upper and lower plates upon which the re-orienting device is mounted.
Figure 10:
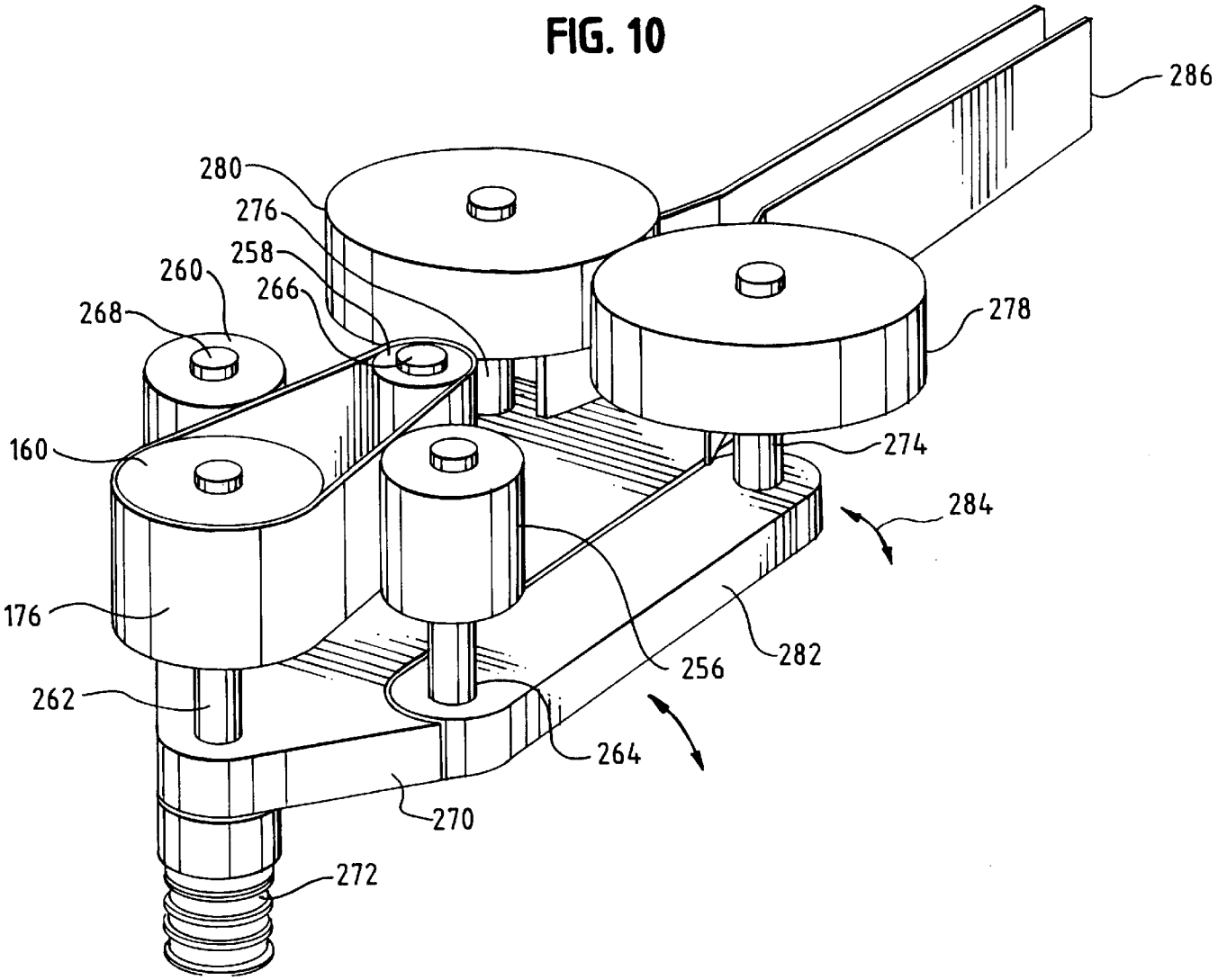
FIG. 10 is a perspective view of the major elements of the re-orienting device of FIG. 9.

The details of one of the re-orienting devices 252A, B, C is illustrated in FIGS. 8, 9 and 10. An entrance nip 254 is formed between roller 160 and a guide roller 256. Belt 176 extends around roller 160, and around roller 158. A second guide roller 260 is located on the opposite side of belt 176 in relation to guide roller 256. Each of rollers 160, 258 and guide rollers 256 and 260 are rotatably mounted on respective shafts 262, 264, 266 and 268. These shafts are all fixed to a plate 270, and plate 270 is rotatable about a downward extension 272 of shaft 262 (FIG. 10).

As best seen in FIGS. 9 and 10, a pair of shafts 272, 276 also extend upward from plate 270, and nip rollers 278, 280 are rotatably mounted on shafts 274, 276 respectively. Shaft 274 is mounted on a pivotal segment 282 of plate 270, which is biased in the counterclockwise direction as viewed in FIGS. 9 and 10, wherein pivotal segment 282 is mounted for limited horizontal pivoting movement about shaft 264, as indicated by the arrow 284. This pivotal movement of segment 282 permits the size of the nip between rollers 278 and 280 to adjust to accommodate the placement of documents of different thicknesses in the nip between rollers 278 and 280. Extending outward beyond one end of plate 270 is a guide bracket 286 which is adapted to guide and hold upright a document which passes between nip rollers 278, 280.

As best seen in FIG. 9, a spring 287 extends between a pin 288 and a pin 290. Pin 288 is fixed to a non-rotatable base plate (not shown) on the structure which supports each document re-orienting device 252A,B,C. Pin 290 is fixed to the underside of rotatable plate 270. Thus, when plate 270 rotates about shaft 262 in either direction, spring 287 urges plate 270 to return to the central position shown in FIG. 8.

Figure 7B:
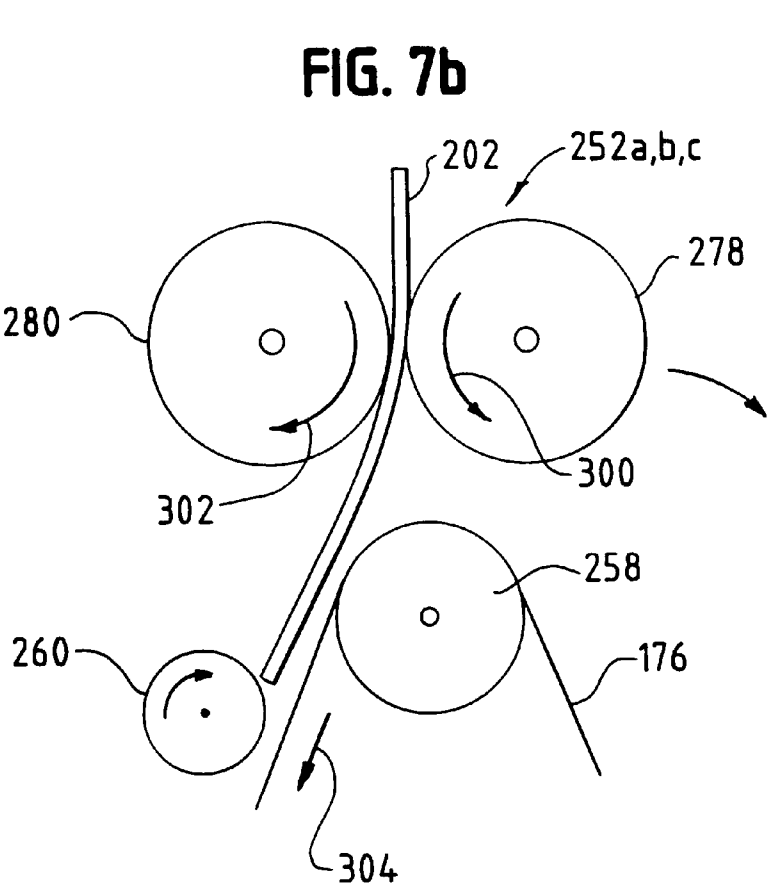
FIG. 7B is a detail plan view of the re-orienting device of FIG. 7A, illustrating the manner in which a document is discharged upon rotation of the nip rollers, and how the movement of the exiting document rotates the re-orienting device.
Figure 7A:
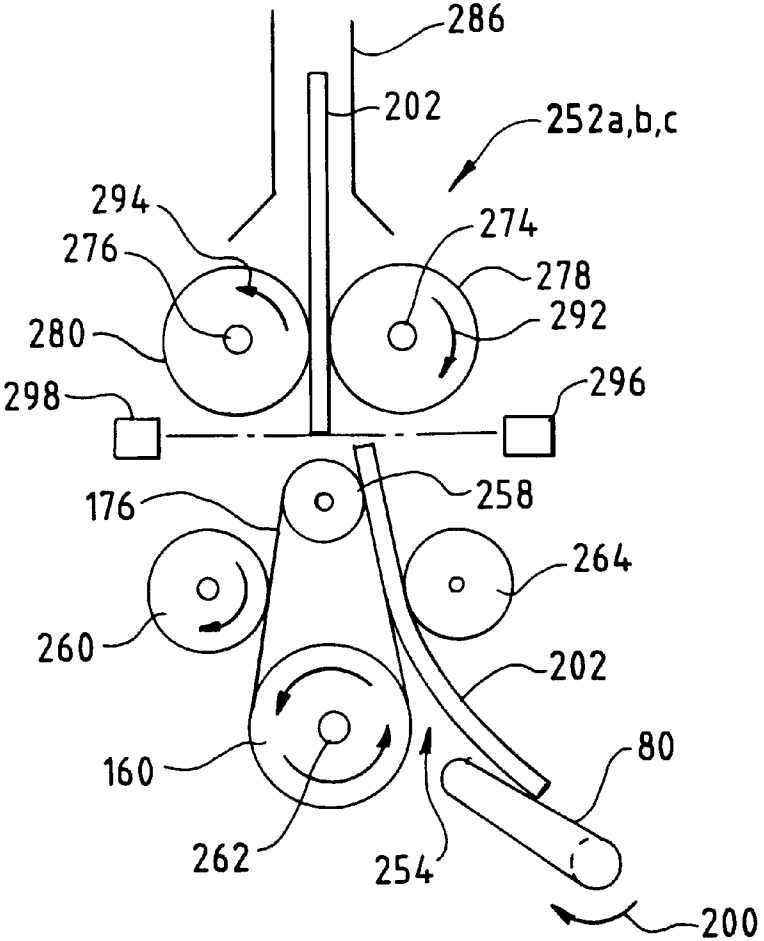
FIG. 7A is a detail plan view of one of the re-orienting devices of FIG. 7, illustrating the manner in which a document enters into and is held in the nip rollers of the re-orienting device, including the location of the sensors which control the rotation of the nip rollers.

The operation of the embodiment of the invention disclosed in FIGS. 7–10 can best be understood with reference to FIGS. 7A and 7B, wherein a document 202 has been diverted by diverter mechanism 80 into the nip 254 between roller 160 and guide roller 256. Document 202 is advanced under the influence of belt and roller assembly 62 into the nip 254 formed between roller 256 and belt 176. Document 202 is advanced until the leading edge is gripped in the nip between rollers 278 and 280, which are driven in the direction indicated by arrows 292, 294. As the trailing edge of document 202 clears the outer circumference of roller 258, sensors 296, 298 detect the edge of document 202 and stop the rotation of nip rollers 278, 280. Document 202 is then held between the nip rollers in guide bracket 286 under the pressure of pivotal segment 282 (FIGS. 9, 10) which biases roller 278 toward roller 280.

As document 202 enters nip 254, and a bending moment is applied to the leading edge of the document by guide roller 264 and belt 176, the document resists bending in proportion to its thickness. In reaction to the bending moment, plate 270 (FIGS. 9, 10) rotates counterclockwise, as shown in phantom in FIG. 8, providing a substantially straight line transport path from nip 254 to the nip formed between rollers 278, 280. Thus, the document 202 is engaged between rollers 278, 280 without undue bending of the document. When the trailing edge of document 202 moves past the outer circumference of roller 258, the reaction force ceases, and plate 270 (FIGS. 9, 10) is rotated back to its central position under the influence of spring 287 (FIGS. 8, 9).

When document 202 is to be released from a re-orienting device 252A, B, C, a signal is sent from the microprocessor controller to initiate the drive mechanisms for nip rollers 278, 280, and the nip rollers with the document 202 between them are rotated in the direction shown by arrows 300, 302 in FIG. 7B. Document 202 is advanced from the rollers 278, 280 until the leading edge of the document contacts the upper reach of belt 176, which is driven in the direction shown by arrow 304. The document's leading edge is forced to the left, as viewed in FIG. 7B, and into the nip between guide roller 260 and belt 176. Document 202 is driven forward by belt 176 until the document is engaged between moving belt 74 and belt and roller assembly 220 (FIG. 8). The document 202 then continues along document path 16, properly faced.

When document 202 is being released from re-orienting device 252A, B, C, roller 260 and belt 176 tend to bend the document relative to nip rollers 278, 280. This bending moment is resisted by the document in proportion to its thickness and rigidity, and this resistance force causes plate 270 (FIGS. 9, 10) to rotate clockwise, as viewed in FIG. 8. This rotation of plate 270 continues until the path between assembly 220, the nip between guide roller 260 and belt 176, and the nip formed between rollers 278 and 280 becomes substantially a straight line. This relieves the bending of the document. After the trailing edge of document 202 clears the nip between guide roller 260 and belt 176, plate 270 and all of the components of re-orienting device 252A, B, C return to a central position under the influence of spring 287, as illustrated in FIGS. 7 and 8.

While other modifications to the various embodiments of the inventive mechanism described above will be apparent to those skilled in the art, it is the intent of the inventors not to be limited other than by the claims attached hereto.

We claim:

1. A document transporting system conveying documents along a transport path in a first direction from a document infeed station to a document processing station, certain of such documents being advanced along the transport path from the infeed station with an improper facing orientation, comprising:

a plurality of document re-orienting devices disposed adjacent the transport path between the infeed station and the document processing station;

each of said document re-orienting devices disposed adjacent the transport path between the infeed station and the document processing station;

each of said document re-orienting devices adapted to receive an improperly oriented document, to reverse the orientation of the previously improperly oriented document, and to transport the correctly oriented document back onto the document transport path;

control means operatively associated with each of the plurality of document re-orienting devices for delivering improperly oriented documents into a pre-selected empty one of the plurality of document re-orienting devices, and for transporting selected correctly oriented documents onto the transport path when a gap is present between documents being transported along the document transport path, wherein said gap is generated from one of said plurality of document re-orienting devices.

2. The document transporting system of claim 1 wherein each document re-orienting device includes a document entrance nip, and a diverter mechanism is disposed adjacent the document entrance nip and opposite the transport path;

actuation of the diverter mechanism causing the diversion of a document being conveyed along the transport path to be directed into the document entrance nip.

3. The document transporting system of claim 2 wherein a document diverted into a re-orienting device remains in the re-orienting device until the gap appears ahead of the re-orienting device in the documents being advanced along the transport path.

4. The document transporting system of claim 3 including additional control means for generating at least one gap in the documents being advanced along the transport path when documents are present in each of the re-orienting devices, said at least one gap adapted to receive the documents;

the control means further actuating the re-orienting devices to advance the document in a respective re-orienting device into the at least one gap in the document transport path.

5. The document transporting system of claim 1 wherein said control means includes a first sensor to detect a document that is not correctly oriented, and to generate a signal in response to detecting the incorrectly oriented document.

6. The document transporting system of claim 2 wherein said control means includes a first sensor to detect a document that is not correctly oriented, and to generate a signal in response to detecting the incorrectly oriented document;

the signal being electronically transmitted to an actuator for the diverter mechanism which actuates said diverter mechanism and directs the improperly oriented document into the re-orienting device adjacent the actuated diverter mechanism.

7. The document transport system of claim 3 wherein the control means includes a gap sensor to detect a gap in the documents being advanced along the transport path and to create a corresponding signal;

said signal electronically transmitted to at least one re-orienting device to release a document retained in the re-orienting device into the gap in the documents being advanced along the document transport path.

8. The document transporting system of claim 1 including:

a belt and roller assembly adjacent an exit of each document re-orienting device, the belt and roller assembly forming a nip between the belt and roller assembly and a transport belt forming part of the document transport path;

the nip adapted to receive and advance a properly oriented document from the exit of the re-orienting device.

9. A method of re-orienting the facing of improperly faced documents in a stream of documents being advanced along a document transport path, comprising the steps of:

a) providing a plurality of document re-orienting devices adjacent the transport path:

b) detecting an improperly faced document in the stream of documents;

c) removing the improperly faced document from the stream of documents;

d) changing the orientation of the removed document in relation to the orientation of the documents in the stream of documents;

e) creating a gap by one of said plurality of re-orienting devices:

f) detecting the presence or absence of a gap in the stream of documents, which gap is ahead of the removed document; and g) advancing the previously removed and re-oriented document into the gap in the document stream.

10. The method of claim 9 wherein the step of removing the improperly faced document includes the step of diverting the improperly faced document from the document stream into one of the plurality of re-orienting devices.

11. The method of claim 10 wherein the step of changing the orientation of the removed document is performed by said one of the plurality of re-orienting devices.

12. The method of claim 9 wherein the step of detecting a gap in the stream of documents occurs adjacent a document infeed station disposed upstream of a location where the improperly faced document is removed from the stream of documents.

13. The method of claim 9 wherein the step of changing the orientation of the removed document includes:

a. advancing the removed document in an angular direction relative to the stream of documents by applying an advancing force to a first face of the removed document;

b. applying a lateral force to the removed document, which lateral force places a second face of the removed document in contact with a driving force moving in a direction opposite to which the removed document was previously advanced, and which lateral force also changes the angle of the removed document relative to the advancing stream of documents;

c. said driving force advancing the previously removed document at the changed angle into the gap in the document stream.

14. The method of claim 9 further including the step of creating a gap in the stream of documents if no gap is detected.

15. A method of re-orienting the facing of improperly faced documents in a stream of documents being advanced along a document transport path, comprising the steps of:

a. detecting a first improperly faced document in the stream of documents and advancing and holding said first document in a re-orienting device;

b. detecting a second improperly faced document in the stream of documents and advancing and holding said second document in an additional re-orienting device, thus forming a first gap in the stream of documents;

c. re-orienting the facing of said first document and advancing said re-oriented first document into said first gap;

d. detecting a third improperly faced document in the stream of documents and advancing and holding said third document in a further re-orienting device, thus forming a second gap in the stream of documents;

e. re-orienting the facing of said second document and advancing said re-oriented second document into said second gap;

f. detecting a fourth improperly faced document in the stream of documents and advancing and holding said fourth document in said re-orienting device;

g. detecting a fifth improperly faced document in the stream of documents and advancing and holding said fifth document in said additional re-orienting device, thus forming a third gap in the stream of documents;

h. re-orienting the facing of said fourth document and advancing said re-oriented fourth document into said third gap;

i. detecting a sixth improperly faced document in the stream of documents and advancing and holding said sixth document in said re-orienting device;

j. creating at least one additional gap in said stream of documents, said at least one additional gap disposed ahead of said re-orienting devices relative to the direction said document stream is being advanced;

k. re-orienting the facing of said third document and advancing said re-oriented third document into said at least one additional gap;

l. re-orienting the facing of said fifth document and advancing said re-oriented fifth document into said at least one additional gap; and m. re-orienting the facing of said sixth document and advancing said sixth document into said at least one additional gap.

* * * * *